US005240126A

United States Patent [19]

Foster et al.

[11] Patent Number: 5,240,126

[45] Date of Patent: Aug. 31, 1993

[54] DISPENSING RACK APPARATUS

[75] Inventors: David N. Foster, Westwood; Andrew Shen, Wakefield, both of Mass.; Richard C. Markson, Goshen, N.Y.

[73] Assignee: The Gillette Company, Boston, Mass.

[21] Appl. No.: 890,993

[22] Filed: May 29, 1992

[51] Int. Cl.[5] ..... A47F 5/00

[52] U.S. Cl. ..... 211/59.3; 211/175; 312/71

[58] Field of Search ..... 211/59.3, 59.2, 175, 211/153; 312/71

[56] References Cited

U.S. PATENT DOCUMENTS

| | | | |
|---|---|---|---|
| 2,735,552 | 2/1956 | Shnitzler et al. | 211/49 |
| 2,904,187 | 9/1959 | Johnson et al. | 211/49 |
| 3,164,350 | 1/1965 | Taub | 248/174 |
| 3,191,776 | 6/1965 | Tokash | 211/55 |
| 3,300,057 | 1/1967 | Wheaton | 211/184 |
| 4,351,439 | 9/1982 | Taylor | 211/49 |
| 4,706,821 | 11/1987 | Kohis et al. | 211/59.3 |
| 4,724,968 | 2/1988 | Wombacher | 211/59.3 |
| 4,785,945 | 11/1988 | Rowse et al. | 211/59.2 |
| 4,836,390 | 6/1989 | Polvere | 211/59.3 |
| 4,901,869 | 2/1990 | Hawkinson et al. | 211/59.3 |
| 4,958,739 | 9/1990 | Spamer | 211/153 |
| 4,997,094 | 3/1991 | Spamer et al. | 211/153 |
| 5,024,336 | 6/1991 | Spamer | 211/59.2 |
| 5,050,748 | 9/1991 | Taub | 211/59.2 |
| 5,111,942 | 5/1992 | Bernardin | 211/59.3 |

*Primary Examiner*—Robert W. Gibson, Jr.
*Attorney, Agent, or Firm*—Stephan P. Williams

[57] ABSTRACT

A Dispensing Rack Apparatus is described having a spring biasing system that automatically advances the articles displayed within the rack towards the front of the rack as the foremost articles are removed. The dispensing rack apparatus also includes means for extending both the length and the width of the storage area.

3 Claims, 7 Drawing Sheets

DISPENSING RACK APPARATUS

BACKGROUND OF THE INVENTION

1. Field of the Invention

This invention relates generally to shelf accessories. More specifically, it relates to a product dispensing apparatus for use on retail shelves.

2. Description of the Prior Art

When shelves are randomly loaded with articles a purchaser can not easily locate a specific item. A random storage condition is therefore undesirable not only to most purchasers, but to store owners as well. Various shelf organizer devices have been suggested in the prior art to correct this condition.

For example, U.S. Pat. No. 3,300,057 discloses the use of a shelf organizer comprising a plurality of interlocking horizontal and vertical planar units. These units may be connected to one another in various directions so as to extend the unit(s) in a preferred direction about the length of the shelf area. This '057 organizer, however, incorporates no means for automatically moving articles from the back toward the front of the shelf for easy grasp by the purchaser.

U.S. Pat. No. 2,735,552 also discloses an apparatus used to attractively display packages. Again, however, such an apparatus can not automatically advance an article to an easily retrievable position after other articles have been removed from the stack.

U.S. Pat. No. 3,164,350 discloses a merchandise display stand having an open-topped box-like counter portion. This '350 apparatus does not include any means for automatically advancing articles from the back of the box toward the front of the box.

U.S. Pat. No. 3,191,776 discloses a multiple row display rack with pairs of horizontally-adjustable risers which may be adjusted to the particular width of the article to be displayed. This '776 apparatus apparently relies on gravity to advance each article toward the front of the display rack.

U.S. Pat. No. 2,904,187 discloses a dispensing rack in which hair wave rods are also gravity-fed toward the purchaser's hand.

As can be seen these gravity-feed systems require an extra amount of vertical height to work properly. Most store owners in order to pack the maximum amount of saleable product within their horizontal shelving systems prefer, however, to space each horizontal shelf at a minimum distance above the product resting o the shelf below.

A dispensing apparatus therefore needs to be developed that does not rely on the use of gravity for product advancement toward the purchaser, especially if the vertical height required for a gravity feed system is not available, such as between closely-spaced shelving systems. This dispensing apparatus must maximize the volume of product presented while requiring a minimum amount of shelf space. As a secondary consideration, such a dispensing apparatus also needs to counter the tendency of some product vendors to "pirate" shelf space from a competing vendor. The apparatus should therefore prevent the unauthorized use of the dispensing apparatus by competing vendors.

SUMMARY OF THE INVENTION

The apparatus of the present invention comprises a compact dispensing rack apparatus. Such an apparatus automatically advances the article(s) displayed on the apparatus by use of a pusher located at the back of the article(s), the pusher being spring-loaded so as to automatically advance the article(s) toward the front of the dispensing apparatus. The apparatus includes a front shoulder that counters the action of the spring-loaded pusher and prevents the articles from being pushed from the front of the apparatus. The front shoulder may include on its front wall brand name advertizing by the proper vendor of the articles being dispensed from the apparatus, so as to discourage the unauthorized use of the rack by competing product vendors.

Such a dispensing rack apparatus includes a main body having a track opening defined downwardly therein, and the front shoulder mentioned previously which blocks exit of the articles from the dispensing rack apparatus until the articles are removed manually. The apparatus also includes the pusher which is slideably engaged within the track opening, the pusher having an article contact surface shaped to contact a portion of the article. The apparatus also includes, in the preferred embodiment, a negating spring which is operatively engaged between the main body and the pusher so as to urge the pusher toward the front shoulder and to thereby urge an articles placed in front of the pusher toward the front shoulder.

It is therefore a feature of the invention to include a spring-driven pusher at the back end of a stack of articles so as to automatically feed the articles toward the front of a dispensing rack.

It is also a feature of the invention to include a front wall on the front shoulder, the front wall displaying brand name advertizing to discourage unauthorized use of the rack by competing vendors. The brand name advertizing may preferably be formed either bas-relief or alto-relievo in the front wall to discourage a competing vendor from attempting to place his (relatively planar) adhesive advertizing sticker over the resultant planar distortions formed by the advertizing in the front wall.

These and other features, objects, and advantages of the present invention will become apparent in the following detailed description, wherein references are made to the Figures in the accompanying drawings.

IN THE DRAWINGS

DESCRIPTION OF THE PREFERRED EMBODIMENT

Figure 1:
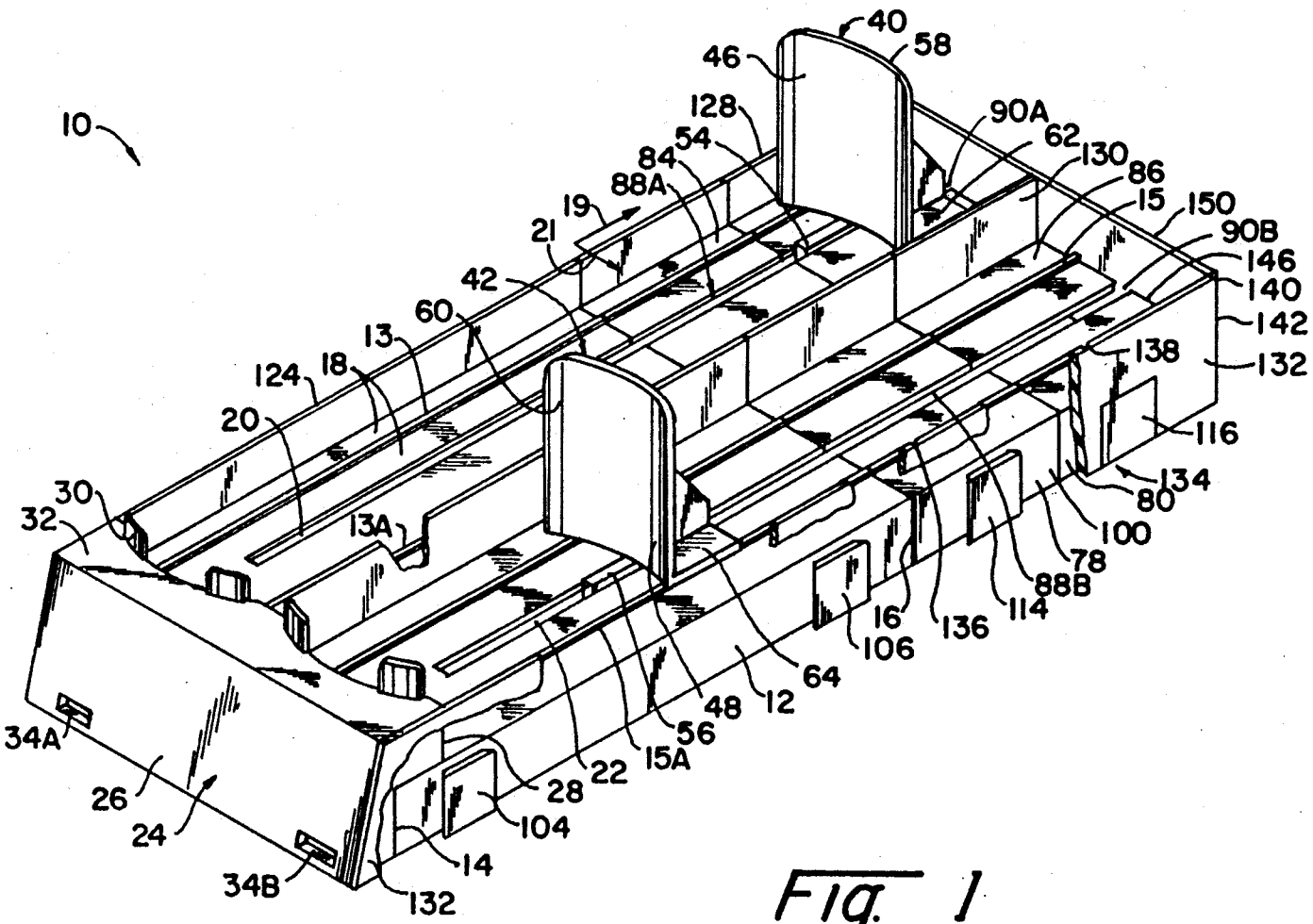
FIG. 1 is a diagrammatic isometric view in partial cross section of the dispensing rack apparatus.

Referring now to FIG. 1 the dispensing rack apparatus 10 of the present invention is shown. The articles dispensed from the apparatus have not been shown for the purposes of visual clarity, but may include, for example, deodorant packages, refrigerated or unrefrigerated soft drink bottles or cans, fruit juice containers, lipstick containers, and/or individual packages of cigarettes. The articles may have many different shapes and sizes as is well known to the art.

Apparatus 10 can be seen to include a main body 12 having a front end 14 and a back end 16 and a carrying surface 18 for carrying the articles thereon. Carrying surface 18 in a preferred embodiment can also be seen to include raised ribs 13, 13 A, 15, and 15 A formed upwardly thereon that the articles rest upon.

For sake of descriptive clarity, longitudinal axis 19 is shown visually oriented relative to the longer dimension of the dispensing rack apparatus, whereas lateral axis 21 is shown located relative to the "shorter" dimension of the dispensing rack apparatus.

It should be well understood that whereas apparatus 10 is shown capable of dispensing two separate columns of articles, the apparatus in an alternative embodiment may include a single column, or a plurality of columns wherein three or more article dispensing columns may be incorporated within the same main body 12.

In the two-column preferred embodiment shown in FIG. 1, the surface 18 can understandably be seen to have two track openings, notably track opening A 20 and track opening B 22, defined downwardly therein.

Apparatus 10 can also be seen to include front stop means 24 in a preferred embodiment comprising front wall 26. The front stop means are operatively engaged to the front end 14 of the main body, the front stop means having a shoulder 28 formed adjacent the front end of the main body to block exit of the articles (not shown) from the apparatus until the articles are removed manually. Shoulder 28 in a preferred embodiment would include at least one curvilinear contact surface 29 (FIG. 5) shaped to cradle the article and to preferably orient the article facing forward. Depending on the height of the articles that are carried on the article carrying surface 18, stock stops 30 may be placed at the upper surface 32 of the front wall 26 so as to prevent the articles from tipping forward unacceptably.

Figure 7:
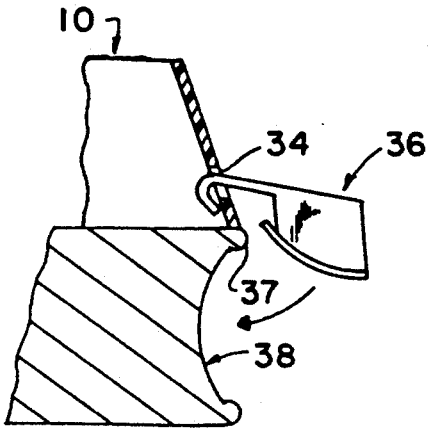
FIG. 7 show a schematic representation in a side view in cross section of the dispensing rack apparatus about to be clipped to the support shelf by a clip inserted in a clip opening.

Front wall 26 can also be seen to include clip openings 34A and 34B for insertion of clip 36 (please reference FIG. 7). The clip 36 may be rotated downwardly into operative locking engagement with upper lip portion 37 of the support shelf 38 so as to restrict movement of the apparatus 10 about the confines of the support shelf. Adhesive pads 39 (FIG. 2) in a preferred embodiment may also be used to dimensionally-stabilize the apparatus 10 on the shelf.

Returning now to FIG. 1, apparatus 10 can also be seen to include article pusher means A 40 such as pusher A 58; and article pusher means B 42 such as pusher B 60; slideably engaged within track openings A 20 and track opening B 22 respectively. The pushers 58, 60 can be seen to include article contact surfaces A 46 and B 48 respectively, shaped to contact a portion of the article, and in a preferred embodiment shaped to aid in presenting the article(s) in a preferred orientation (preferably facing forward) relative to the front of the apparatus. It should be well understood that these pushers can be replaced with new pushers having a different shape if the shape of the dispensed article is changed.

Apparatus 10 also includes biasing means A 50 and biasing means B 52 (reference FIG. 2) operatively engaged between the main body and the article pusher means 40, 42, in a preferred embodiment being operatively engaged to centralizer rib A 54 and centralizer rib B 56 which is connected to the bottom portion of pusher A 58 and pusher B 60 (FIG. 1). The centralizer ribs extend through the track openings and keep the pushers favorably aligned toward the front of the apparatus.

Pushers 58, 60 can also be seen to include base A 62 and base B 64 carried by the carrying surface 18. Upward movement of the pusher 60, 62 away from the carrying surface is prevented by inclusion of base cross A 66 and base cross B 68 located adjacent the bottom surface 70 of the main body. Centralizer ribs 56, 54 along with base crosses 68, 66 and bases 62, 64 may slide freely along the length of the track openings defined in the main body, as well as track openings defined in any other bodies attached to the main body having common track openings defined therethrough.

The biasing means A 50, and B 52 comprise in a preferred embodiment spring A 70 and spring B 72. These springs are commercially available from Vulcan Spring and Manufacturing Company, 501 Schoolhouse Road, Telford, Pa. 18969. The springs are typically operatively engaged to the main body at spring posts A 74 and spring post B 76 and are attached to the centralizer ribs 54, 56 by fastening means such as a threaded screw and nut, as is well known to the art.

It is very important to note that these types of springs 70, 72 allow the pushers 58, 60 not only to work effectively within the track opening of the main body, but also to continue to operate effectively while extended backward into extension body A 78 and or extension body B 80. The springs in a preferred embodiment are located at the front of the track openings so that the biasing action on the pushers may be maintained as the pushers are extended backward into successive extension bodies. It should be well understood that other types of spring systems may be used to accomplish the same mechanical result.

In any event, the biasing means can be seen to be operatively engaged between the main body and the article pusher means to urge the pusher means toward the shoulder 28 of the front stop means. It can be seen therefore that articles placed between the article pusher means and the shoulder on the carrying surface are thereby urged by the pusher means toward the shoulder. The biasing effort of the springs 70, 72 can be adjusted to accommodate articles having varying weight and resultant components of sliding friction.

The dispensing rack apparatus 10 in an alternative embodiment can also be seen to further include length extension means 82 such as extension body A 78 and extension body B 80 mentioned previously. The length extension means can be seen to be operatively engageable with the back end 16 of the main body, the length extension means having a surface for carrying the articles, as well as at least one track opening defined downwardly within the surface. These surfaces 84, 86 and track openings 88 A, and 88 B of extension body A, and track openings 90 A, and 90 B of extension body B 80 in a preferred embodiment are defined common with the surface and track openings of the main body. The article pusher means can therefore be seen to be slideably engageable within the track opening of the length extension means, and when located within the track opening of these length extension means, can be seen to be urgeable by the biasing means toward the shoulder of the main body.

Figure 4:
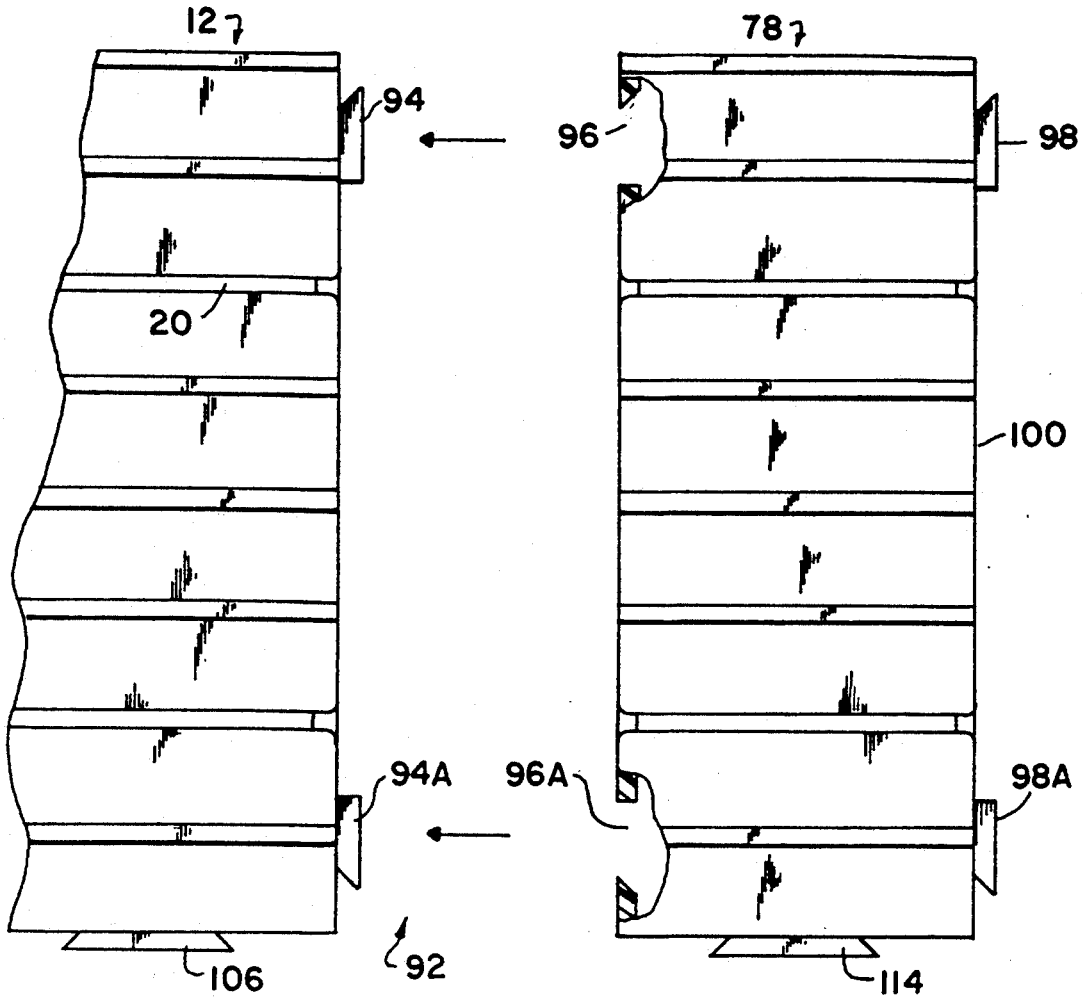
FIG. 4 shows a schematic representation in a top view in partial cross section of the dispensing rack apparatus of the present invention.

In one embodiment the length extension means, such as extension body A 78 may be operatively engaged to the main body by lateral interlock means 92 (reference FIG. 4) formed by cooperatively shaped portions of the main body and the length extension means. One of these portions may include at least one beveled lug 94, (94A). Another of the portions may include a cooperatively shaped beveled opening 96, (96A) shaped to receive the beveled lug 94, (94A). It should be well understood that many other mechanical systems may be used to accomplish the same mechanical result of fixably attaching an extension body to the back end of the main body, for the purpose of dispensing articles from the resulting combined apparatus, while still allowing for the subsequent removal of the extension body from the main body. Additional extension bodies, such as extension body B 80 (FIG. 1) may be engaged in a similar manner to lugs 98, 98A operatively included on the back end 100 of extension body A.

Figure 8:
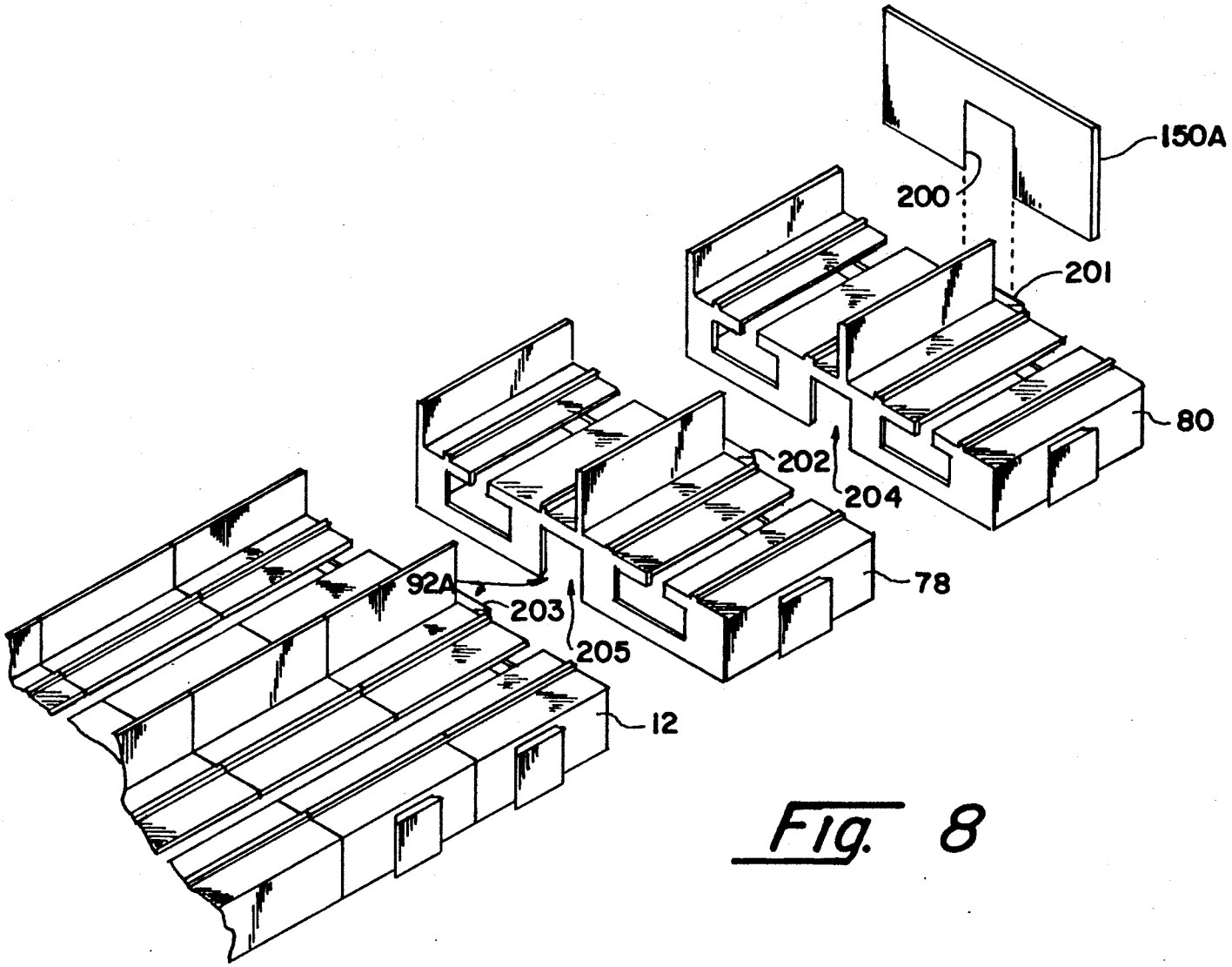
FIG. 8 shows a diagrammatic isometric view of an alternative embodiment of the end wall and body interlock system.

In a preferred embodiment the length extension means are operatively engaged to the main body or to each other by lateral interlock means 92A (reference FIG. 8) formed by cooperatively shaped portions of the main body and the length extension means, preferably centrally located single lug(s) 202 and 203 operatively engageable with beveled openings 204 and 205 respectively, as described more fully hereinbelow.

It can therefore be seen that the overall length of the apparatus is only limited by the number o sections available to be joined to the back end of the main body, the length and resiliency of the biasing system, and the available shelf space. An article vendor may therefore tailor the overall length of the dispensing apparatus to fit the shelf system currently available at the point of sale.

Figure 2:
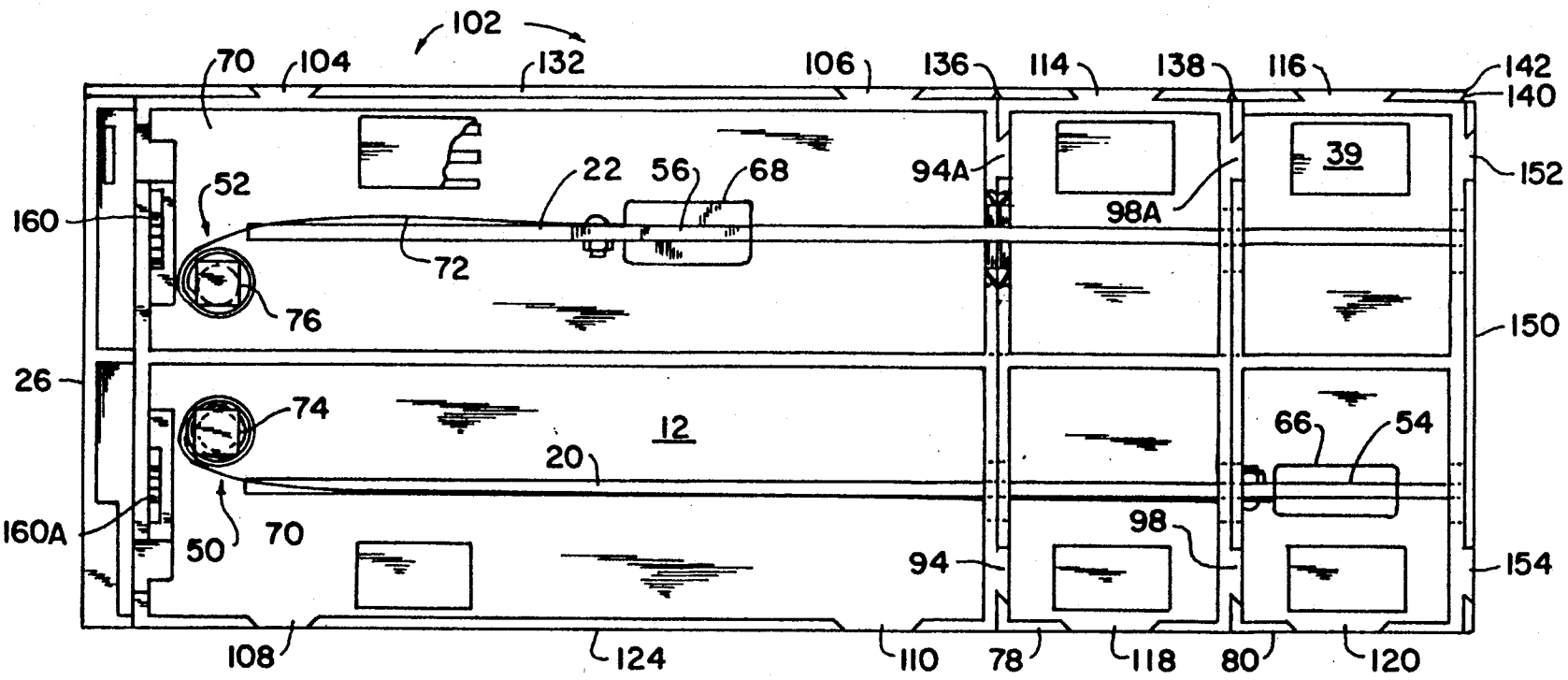
FIG. 2 shows a schematic representation in a bottom view of the dispensing rack apparatus of the present invention.
Figure 3:
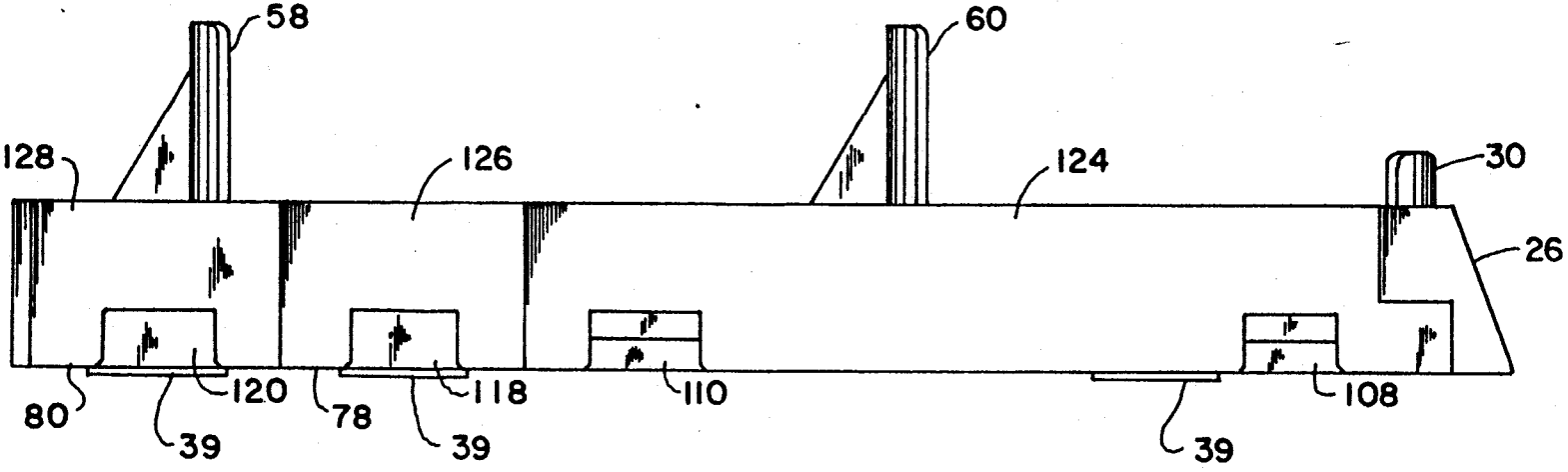
FIG. 3 shows a schematic representation in a side view of the dispensing rack apparatus of the present invention.

Referring now to FIGS. 1 and 2 the dispensing rack apparatus 10 can be seen to further include longitudinal interlock means 102 formed along each side of the main body by cooperatively shaped portions of the sides of the main body. One of the portions includes at least one beveled lug, such as lugs 104, 106. Another of the portions includes at least one cooperatively shaped beveled opening, such as beveled opening 108, 110 to receive similarly shaped beveled lugs formed on opposite sides of an equivalent dispensing rack apparatus.

Figure 6:
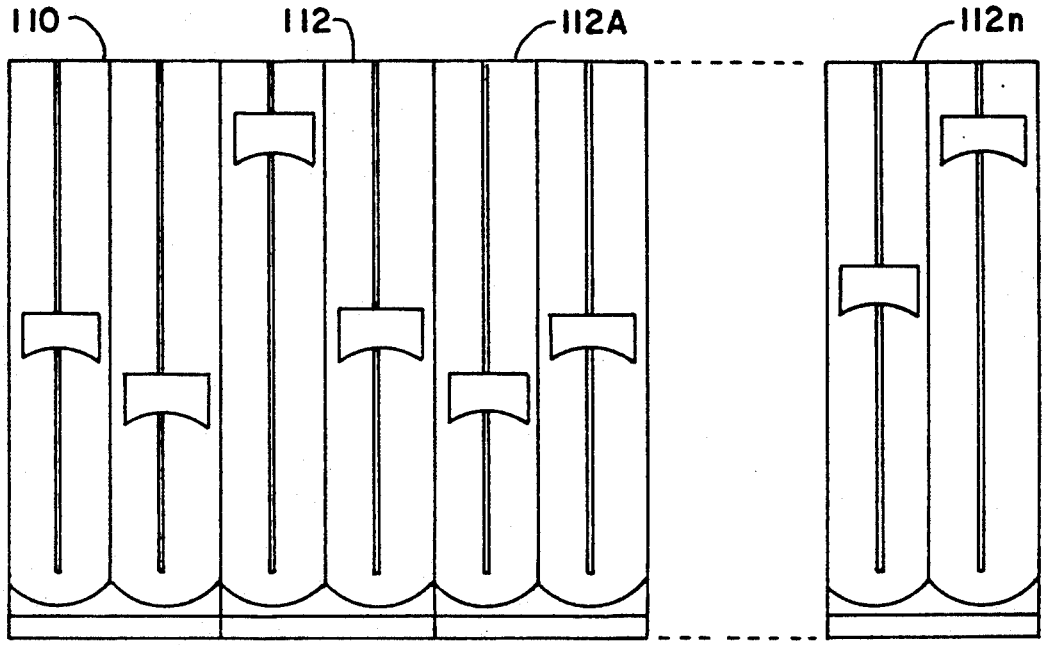
FIG. 6 shows a schematic representation in a top view of one dispensing rack apparatus joined to another dispensing rack apparatus of the present invention.

In other words the longitudinal interlock means may be used to join the sides of two or more display apparatus placed adjacent one another on the storage shelf, by use of an equivalent pair of lugs 104, 106 and equivalent matching pair of beveled openings 108, 110. The resulting joined apparatus structure is shown in FIG. 6, wherein dispensing rack apparatus A 110 is shown joined to dispensing rack apparatus B 112. It should be well understood that many other mechanical methods may be used to join adjacent apparatus 110, 112 together sufficiently to dimensionally stabilize the apparatus on the store shelves.

The longitudinal interlock means may also be formed not only along each side of the main body but in an alternative embodiment may also extend along the sides of any length extension means added to the main body, such as by addition of lug A 114 and lug B 116 on extension body A 78 and extension body B 80 respectively, and beveled openings A 118 and B 120 formed on the opposite side to aid in joiner with an adjacent display apparatus having a matching longitudinal interlock system.

When it is not necessary or desired to join one apparatus to an adjacent apparatus, the lugs 104, 106, and/or lugs 114, 116 present unsightly non-functional projections from the main body and extension bodies attached thereto. It is also desirable to attach a wall of some nature to the side of the main body and/or extension bodies to prevent the articles from falling out over the sides. Whereas main body side wall 124 and/or side wall A 126 and side wall B 128 may be formed common with their respective body elements and/or extensions thereof, and whereas middle wall 130 (shown formed common with the main body and any extensions thereof), may be used to stabilize the articles pushed by pusher A 58, it is desirable to add a wall to the open side of the rack apparatus when the apparatus is not joined to an adjacent apparatus.

The rack apparatus may therefore include a frangible side wall 132 having at least one beveled opening shaped to cooperatively engage the lugs 104, 106 and/or lugs 114 and 116. The frangible side wall can be seen to have a failure notch 136 formed adjacent the location of operative engagement of the length extension means to the main body, and also may in a preferred embodiment include a failure notch formed adjacent the location of the joiner of successive length extension means (such as notch 138 or 140). Notch 140 defines the location of a failure line 142 in the frangible side wall at the furthermost end 146 of the dispensing rack apparatus 10.

The frangible side wall 132 is preferable supplied longer than the anticipated overall length of the apparatus. Once the appropriate number of extension bodies have been added to the main body, the frangible wall is adjusted to the correct length by snapping off the unneeded length of the wall, such as at failure line 142 as shown in FIG. 1. The frangible wall is thereafter pushed downwardly on the lugs 104, 106, 114, 116 as shown to form the required side wall to keep the articles from falling over the edge of the apparatus.

End wall 150 in one embodiment may be operatively engaged to the end of the apparatus by engagement of beveled openings with lugs 152, 154 (reference FIG. 2). In this way, the walls 150 and 132 may be fabricated to accommodate the final length and width of the dispensing rack apparatus.

In a preferred embodiment end wall 150A may be operatively engaged to the end of the apparatus by engagement of a single beveled opening 200 (reference FIG. 8) with a centrally located lug 201. Extension bodies 78 and 80 may also be joined to one another and to main body 12 with a centrally located lug 202 and 203 respectively, cooperating with beveled openings 204 and 205 respectively. End wall 150A need not span the entire length of the back of the extension 80 because the product dispensed from the apparatus 10 rests against the pushers 58 and 60, not the end wall 150A. It should be well recognized that end wall 150A may be deleted if desired without affecting the operability of the apparatus 10.

End wall 150A can of course be attached directly to lug 203 if the extension bodies are not used.

Figure 5:
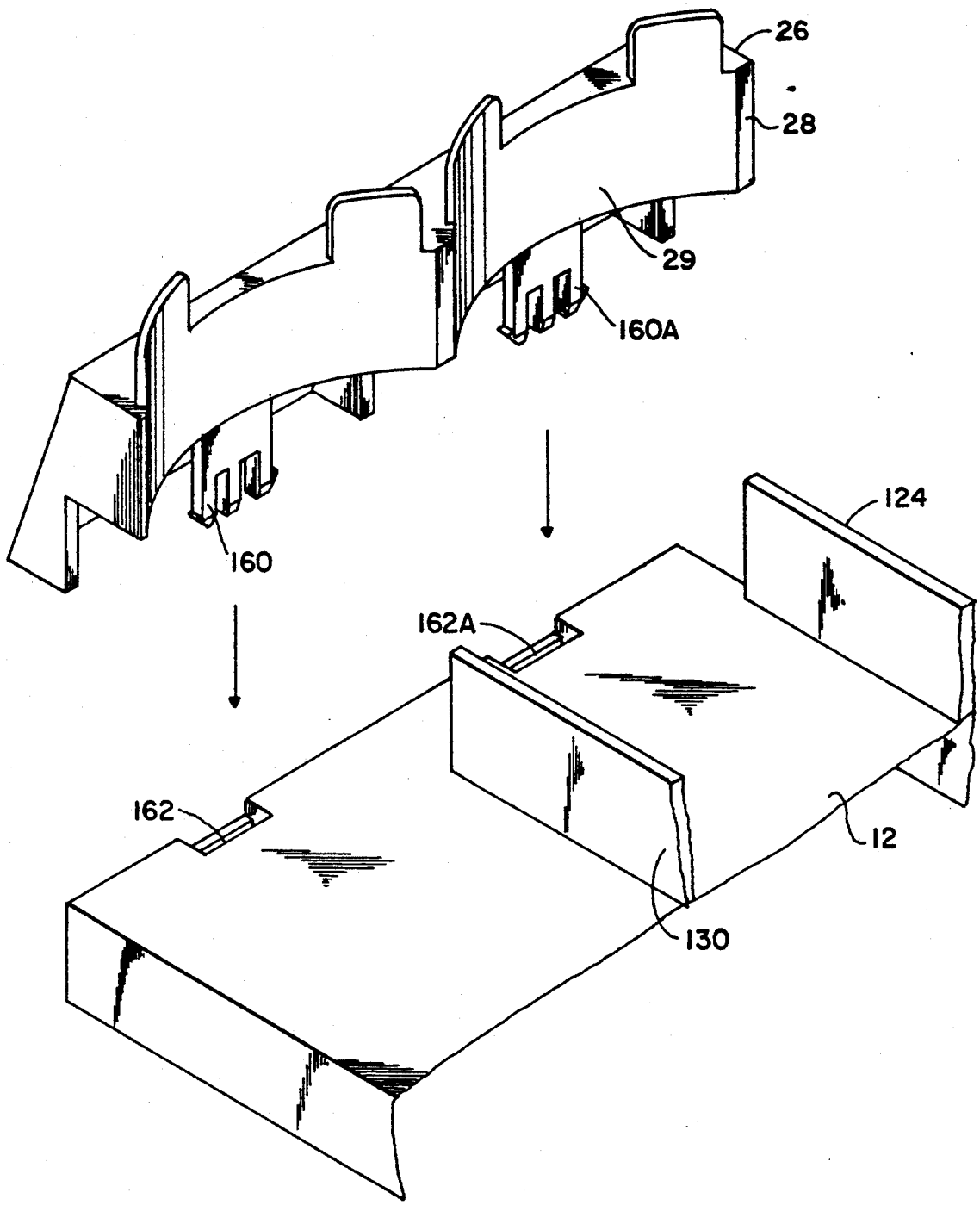
FIG. 5 shows a schematic representation in a diagrammatic isometric view of the front wall prior t operative engagement with the main body of the dispensing rack apparatus of the present invention.

Referring now to FIG. 5, it can be seen that the front wall 26 of the apparatus may be removed and attached to the main body 12 of the apparatus by use of shaped insert pins 160, 160A insertible within cooperating openings 162, 162A. The degree of difficultly of inserting and/or removing the front wall from attachment to the main body may be varied by the design of the pins as is well known to the art. In an alternative embodiment the front wall may be made readily removable so as to aid in the loading of the articles within the dispensing rack apparatus, especially if another shelf is located immediately above the dispensing rack apparatus.

Many other variations and modifications may be made in the apparatus and techniques hereinbefore described, both by those having experience in this technology, without departing from the concept of the present invention. Accordingly, it should be clearly understood that the apparatus depicted in the accompanying drawings and referred to in the foregoing description is illustrative only, and is not intended as a limitation on the scope of the invention.

We claim as our invention:

1. A dispensing rack apparatus for dispensing articles therefrom, said apparatus comprising:

a main body having a front end and a back end and a surface for carrying said articles, said surface having at least one track opening defined downwardly therein, front stop means operatively engaged to said front end of said main body, said front stop means having a shoulder formed adjacent the front end of said main body to block exit of said articles from said apparatus, article pusher means slideably engaged within said track opening, said pusher means having an article contact surface shaped to contact a portion of said article, biasing means operatively engaged between said main body and said article pusher means to urge said pusher means toward said shoulder of said front stop means, articles placed between said article pusher means and said shoulder on said carrying surface urged by said pusher means toward said shoulder, optional length extension means operatively engageable with said back end of said main body by lateral interlock means formed by cooperatively shaped portions of said back end of said main body and said length extension means, said length extension means having a surface for carrying said articles and a track opening defined downwardly within said surface, said surface and said track opening defined common with said surface and said track opening of said main body, said article pusher means slideably engageable within said track opening of said length extension means and when located within said track opening urgeable by said biasing means toward said shoulder of said main body, and longitudinal interlock means formed along each side of said main body and said optional length extension means by cooperatively shaped portions of said sides of said main body and said length extension means, said longitudinal interlock means used to join display apparatus placed adjacent one another.

2. The apparatus of claim 1 wherein said cooperatively shaped portions of said lateral and longitudinal interlock means comprise at least one beveled lug and a cooperatively-shaped beveled opening to receive said beveled lug.

3. The apparatus of claim 2 further including a frangible side wall having at least one beveled opening shaped to cooperatively engage said at least one beveled lug, said frangible side wall having a failure notch formed adjacent the location of operative engagement of said length extension means to said main body and adjacent the location of joinder of successive length extension means, said notch defining the location of a failure line in said frangible side wall at the furthermost end of said apparatus.

* * * * *